US008444429B2

(12) United States Patent
Ebihara et al.

(10) Patent No.: US 8,444,429 B2
(45) Date of Patent: May 21, 2013

(54) UNLOCKING DEVICE, CONNECTOR DEVICE, AND CONNECTOR

(75) Inventors: Hiroyuki Ebihara, Tokyo (JP); Makoto Sangu, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 13/254,428

(22) PCT Filed: Feb. 24, 2010

(86) PCT No.: PCT/JP2010/052834

§ 371 (c)(1),
(2), (4) Date: Sep. 1, 2011

(87) PCT Pub. No.: WO2010/101050

PCT Pub. Date: Sep. 10, 2010

(65) Prior Publication Data

US 2011/0318947 A1 Dec. 29, 2011

(30) Foreign Application Priority Data

Mar. 4, 2009 (JP) ..... 2009-050648

(51) Int. Cl.
*H01R 13/62* (2006.01)

(52) U.S. Cl.
USPC ..... 439/352

(58) Field of Classification Search
USPC ..... 439/352, 353, 350
See application file for complete search history.

(56) References Cited

U.S. PATENT DOCUMENTS 5,207,593 A * 5/1993 Bogiel ..... 439/352
6,132,231 A * 10/2000 Suzuki ..... 439/352
6,457,987 B1 * 10/2002 Yeh ..... 439/352
6,860,748 B2 * 3/2005 Ohtani et al. ..... 439/352

FOREIGN PATENT DOCUMENTS

JP 2000-228250 A 8/2000
JP 2003-303659 A 10/2003
JP 2003-317866 A 11/2003
JP 2003-346970 A 12/2003

OTHER PUBLICATIONS

International Search Report dated Apr. 6, 2010 (and English translation thereof) in International Application No. PCT/JP2010/052834.

* cited by examiner

*Primary Examiner* — Gary F. Paumen
(74) *Attorney, Agent, or Firm* — Holtz, Holtz, Goodman & Chick, P.C.

(57) ABSTRACT

[Problem]
To prevent a receptacle connector and a plug connector from being erroneously released from a state locked to each other by hand, and to make it possible to easily remove the plug connector from the receptacle connector by an operator alone.
[Solution]
A receptacle housing 4 of a receptacle connector 3 is provided with through holes 411. A plug housing 7 of a plug connector 6 is provided with protrusions 92 which can be engaged in the though holes 411, and leaf springs 711 which urge the protrusions 92 toward the through holes 411. An unlocking jig 9 is formed by a jig main body 91 which can be mounted and removed to and from the receptacle housing 4 of the receptacle connector 3 in a direction D2 perpendicular to a fitting and removing direction D1, and the protrusions 92 which are provided on the jig main body 91 and press lugs 712 against an urging force of the leaf springs 711 when the jig main body 91 is mounted to the receptacle connector 3 to thereby disengage the lugs 712 and the through holes 411.

14 Claims, 13 Drawing Sheets

UNLOCKING DEVICE, CONNECTOR DEVICE, AND CONNECTOR

This application is a U.S. National Phase Application under 35 USC 371 of International Application PCT/JP2010/052834 filed Feb. 24, 2010.

TECHNICAL FIELD

The present invention relates to an unlocking device, a connector device, and a connector, and more particularly to an unlocking device that releases a plug connector and a receptacle connector from a state locked to each other, and to a connector device and a connector, each including a plug connector and a receptacle connector, which are suitable e.g. for electrically connecting between cells of a solar cell module.

BACKGROUND ART

Conventionally, there has been proposed a connector device that comprises a hollow cylindrical connector socket and a hollow cylindrical connector plug which is inserted into the connector socket (see Japanese Laid-Open Patent Publication (Kokai) No. 2000-228250).

The connector socket has two rectangle holes formed therein. The two rectangle holes are opposed to each other in the radial direction of the connector socket.

The connector plug includes two spring pieces extending along a direction of the central axis thereof, which are positioned symmetrically with respect to the central axis of the connector plug. A free end of each spring piece is formed with a locking lug which can be engaged in an associated one of the rectangle holes of the connector socket. The locking lug is formed with an inclined surface for disengaging between the locking lug and the associated rectangle hole.

When the connector plug is inserted (fitted) into the connector socket and the connector plug is rotated in a predetermined direction, the locking lugs of the spring pieces of the connector plug are engaged in the respective rectangle holes of the connector socket, whereby the connector plug is locked to the connector socket, which maintains a state of the two connectors fitted to each other. On the other hand, when the connector plug is rotated in an opposite direction from the predetermined direction from a state in which the connector plug is locked to the connector socket, the engagement between the locking lugs of the spring pieces of the connector plug and the rectangle holes of the connector socket is released, whereby the connector socket and the connector plug are released from the state locked to each other.

As another conventional technique for this connector device, there has been proposed a connector device in which even if a plug connector is rotated in any direction from the state in which the plug connector is locked to a receptacle connector, the engagement between locking lugs of spring pieces of the plug connector and respective rectangle holes of the receptacle connector is prevented from being released. In this connector device, the plug connector can be removed from the receptacle connector by simultaneously putting ends of two screwdrivers into the respective rectangle holes of the receptacle connector to thereby release the engagement between the locking lugs of the spring pieces and the rectangle holes, and pulling the plug connector in this state.

CITATION LIST

Patent Literature

Patent Literature 1: Japanese Laid-Open Patent Publication (Kokai) No. 2000-228250

SUMMARY OF INVENTION

Technical Problem

Although there have been proposed the two connector devices as the conventional techniques as described above, the former connector device (the connector device described in Japanese Laid-Open Patent Publication (Kokai) No. 2000-228250) has a possibility that since engagement between the locking lugs of the spring pieces and the rectangle holes is released by a small amount of rotation of the plug connector, the receptacle connector and the plug connector are erroneously released from the state locked to each other by hand.

In contrast, the latter connector device does not have such a problem. However, to remove the plug connector from the receptacle connector, it is difficult to align the positions of jigs, such as screwdrivers, pull out the plug connector after the engagement between the locking lugs of the spring pieces and the rectangle holes is released, and remove the jigs from the receptacle connector.

The present invention has been made in view of these circumstances, and an object thereof is to prevent an erroneous release of a locked state by hand, and make it possible to easily remove a plug connector from a receptacle connector.

Solution to Problem

To attain the object, in a first aspect of the present invention, there is provided an unlocking jig that releases engagement between through holes of a receptacle connector and protruding portions of a plug connector to thereby release the receptacle connector and the plug connector inserted in the receptacle connector from a state locked to each other, comprising a jig main body that can be mounted and removed to and from the receptacle connector in a direction perpendicular to a direction of fitting and removing the plug connector and the receptacle connector to and from each other, and pressing portions that are provided on the jig main body, for pressing, when the jig main body is mounted to the receptacle connector, the protruding portions against urging forces of spring portions of the plug connector, which urge the protruding portions toward the through holes, to thereby release engagement between the protruding portions and the through holes.

With the arrangement of the unlocking jig according to the first aspect of the present invention, when the unlocking jig is mounted to the receptacle connector in a state locked to the plug connector, the pressing portions of the unlocking jig press the protruding portions of the plug connector against the urging forces of the spring portions to thereby release engagement between the protruding portions and the through holes of the receptacle connector from each other. Therefore, it is possible to easily pull out the plug connector from the receptacle connector.

Preferably, the jig main body has a hollow semi-cylindrical shape, and the pressing portions are a pair of protrusions which are arranged on an inner peripheral surface of one end of the jig main body in a manner opposed to each other in the radial direction, and are guided by respective guide grooves formed in an outer peripheral surface of the receptacle connector such that the guide grooves extend across the respective through holes in the direction perpendicular to the fitting and removing direction.

More preferably, the jig main body is guided by a guide portion formed on the outer peripheral surface of the receptacle connector when being mounted to the receptacle connector, and a pair of attitude-stabilizing protrusions for stabilizing an attitude of the jig main body with respect to the receptacle connector are formed on an inner peripheral surface of the other end of the jig main body in a manner opposed to each other in the radial direction.

To attain the object, in a second aspect of the present invention, there is provided a connector device comprising a receptacle connector, a plug connector that is inserted into the receptacle connector, and an unlocking jig that releases these connectors from a state locked to each other, wherein the receptacle connector has through holes, wherein the plug connector has protruding portions which can be engaged in the through holes, spring portions which urge the protruding portions toward the through holes such that the through holes and the protruding portions are engaged, and a connector main body which supports the spring portions, and wherein the unlocking jig includes a jig main body that can be mounted and removed to and from the receptacle connector in a direction perpendicular to a direction of fitting and removing the plug connector and the receptacle connector to and from each other, and pressing portions that are provided on the jig main body, for pressing, when the jig main body is mounted to the receptacle connector, the protruding portions against urging forces of the spring portions, to thereby release engagement between the protruding portions and the through holes.

Preferably, guide grooves for guiding the pressing portions in the direction perpendicular to the fitting and removing direction when the jig main body is mounted to the receptacle connector are formed in an outer peripheral surface of the receptacle connector such that the guide grooves extend across the respective through holes.

Preferably, the jig main body has a hollow semi-cylindrical shape, and the pressing portions are a pair of protrusions arranged on an inner peripheral surface of one end of the jig main body in a manner opposed to each other in the radial direction.

More preferably, the jig main body has a pair of attitude-stabilizing protrusions formed on an inner peripheral surface of the other end thereof in a manner opposed to each other in the radial direction, and the receptacle connector has a guide portion formed on an outer peripheral surface thereof, which guides the pair of the attitude-stabilizing protrusions when the jig main body is mounted to the receptacle connector to thereby stabilize an attitude of the jig main body with respect to the receptacle connector.

Preferably, the protruding portions each have a shape which causes the connector main body to move in a direction away from the receptacle connector when the protruding portions are pressed by the respective protrusions.

To attain the object, in a third aspect of the present invention, there is provided a connector comprising a receptacle connector and a plug connector that is inserted into the receptacle connector, wherein the receptacle connector has through holes, and the plug connector has protruding portions which can be engaged in the through holes, spring portions which urge the protruding portions toward the through holes such that the through holes and the protruding portions are engaged with each other, and a connector main body which supports the spring portions, and wherein the receptacle connector has an outer peripheral surface formed with guide grooves each of which extends across an associated one of the through holes in a direction perpendicular to a direction of fitting and removing the receptacle connector and the plug connector to and from each other, and receives at least part of an associated one of the protruding portions when the protruding portions are engaged in the respective through holes.

Preferably, when releasing fitting between the receptacle connector and the plug connector, the guide grooves guide respective pressing portions of an unlocking jig for pressing the protruding portions to thereby release engagement between the protruding portions and the respective through holes, in the direction perpendicular to the fitting and removing direction.

Advantageous Effects of Invention

According to the present invention, it is possible to prevent the connectors from being erroneously released from the state locked to each other by hand, and enable the operator to easily remove the plug connector from the receptacle connector by himself.

The above and other objects, features and advantages of the present invention will become more apparent from the following detailed description taken in conjunction with the accompanying drawings.

DESCRIPTION OF EMBODIMENTS

Hereafter, an embodiment of the present invention will be described with reference to the drawings.

Figure 1:
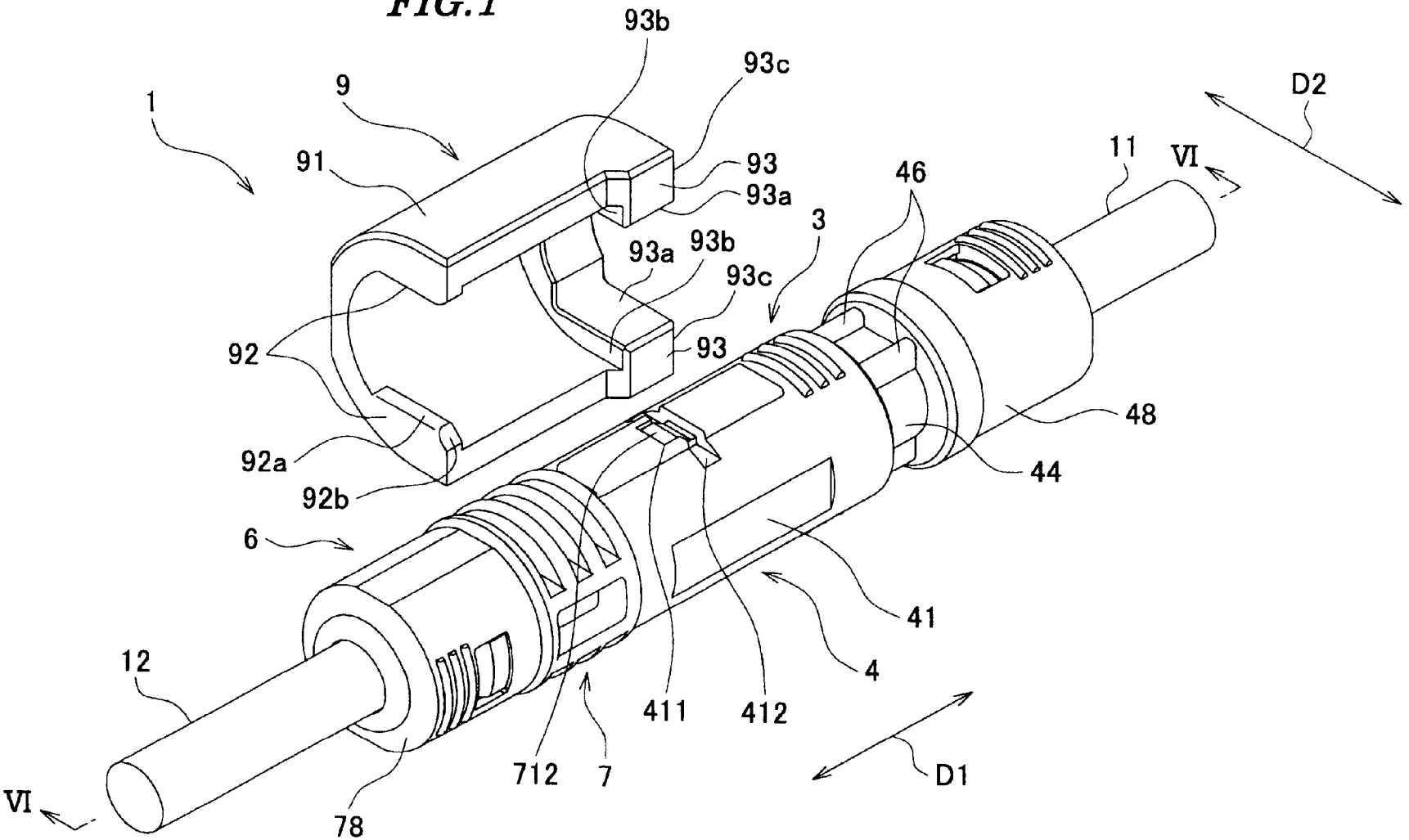
FIG. 1 is a perspective view of a connector device according to an embodiment of the present invention in a state before releasing a receptacle connector and a plug connector from a state locked to each other using an unlocking jig.
Figure 2:
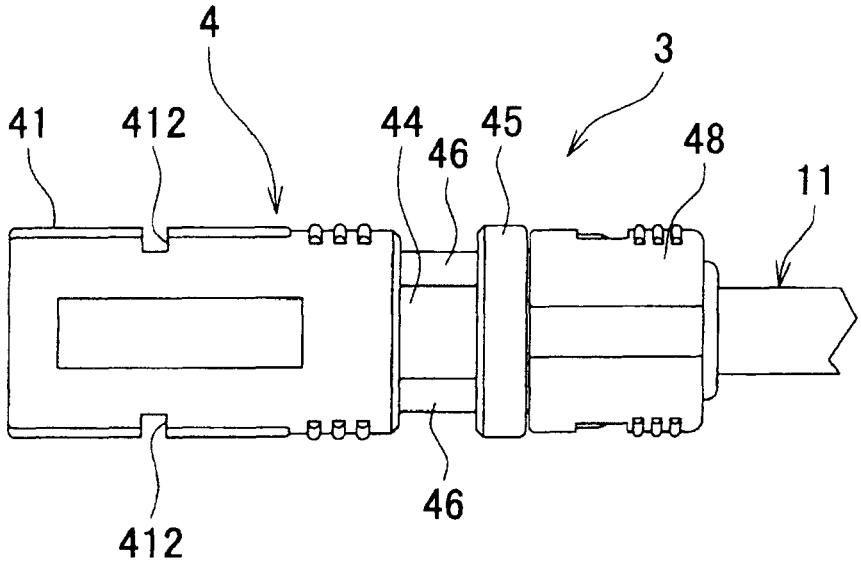
FIG. 2 is a side view of the receptacle connector of the connector device shown in FIG. 1.
Figure 3:
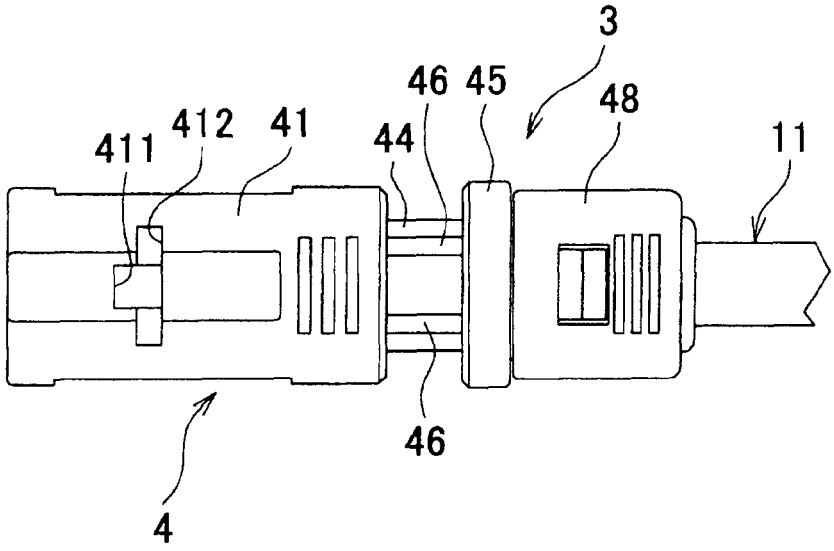
FIG. 3 is a plan view of the receptacle connector of the connector device shown in FIG. 1.

Referring to FIG. 1, a connector device 1 according to an embodiment of the present invention comprises a receptacle connector 3, a plug connector 6, and an unlocking jig 9.

Referring to FIGS. 2, 3, 5, and 6, the receptacle connector 3 includes a hollow cylindrical receptacle housing 4 and a socket contact 5.

The receptacle housing 4 includes a first cylinder portion 41, a second cylinder portion 42, a constricted portion (guide portion) 44, and a wire-holding portion 45. The receptacle housing 4 is integrally molded of e.g. a synthetic resin.

The first cylinder portion 41 has two through holes 411 formed therein. The two through holes 411 are at locations symmetrical with respect to the central axis of the first cylinder portion 41. Each through hole is rectangular-shaped. Further, the first cylinder portion 41 has guide grooves 412 formed in an outer peripheral surface thereof in a manner extending across the respective through holes 411. The guide grooves 412 each extend in a direction D2 (see FIG. 1) perpendicular to a direction D1 (see FIG. 1) of fitting and removing the plug connector 6 and the receptacle connector 3 to and from each other.

The second cylinder portion 42 is accommodated in the first cylinder portion 41, and the central axis of the second cylinder portion 42 coincides with that of the first cylinder portion 41. A circular space 43 is formed between the first cylinder portion 41 and the second cylinder portion 42.

A rear end portion of the first cylinder portion 41 (right part of the first cylinder portion 41 as viewed in FIG. 6) and a rear end portion of the second cylinder portion 42 (right part of the second cylinder portion 42 as viewed in FIG. 6) are connected to each other.

The wire-holding portion 45 is continuous with the respective rear end portions of the first and second cylinders 41 and 42 via the constricted portion 44. The wire-holding portion 45 has a substantially hollow cylindrical shape, and holds a front end portion of a cover 111 of an electric wire 11. A central hole 47 extending through the wire-holding portion 45 and the constricted portion 44 along the central axis is communicated with a space 421 within the second cylinder portion 42. A front end portion of the central hole 47 has an inner diameter smaller than that of the space 421, and the second cylinder portion 42 has an inner peripheral surface formed with a stepped surface 422 (see FIG. 6). A rear end portion 47*b* of the central hole 47 has an inner diameter larger than that of the front end 47*a* of the central hole 47, and accommodates a bushing 49 mounted on an outer peripheral surface of the electric wire 11. A coupling nut 48 is removably mounted on the wire-holding portion 45. The coupling nut 48 mounted on the wire-holding portion 45 prevents the bushing 49 from falling off.

The constricted portion 44 has an outer peripheral surface formed with two pairs of ribs 46. The two pairs of the ribs 46 are at locations symmetric with respect to the central axis of the constricted portion 44. Both of the two pairs of the ribs 46 are arranged with predetermined spacing in a circumferential direction. A virtual straight line (a straight line perpendicular to the central axis) connecting respective front ends (edge lines) of one pair of the ribs 46 and a virtual straight line connecting the respective front ends (edge lines) of the other pair of the ribs 46 are parallel to a bottom surface of the guide groove 412.

Figure 6:
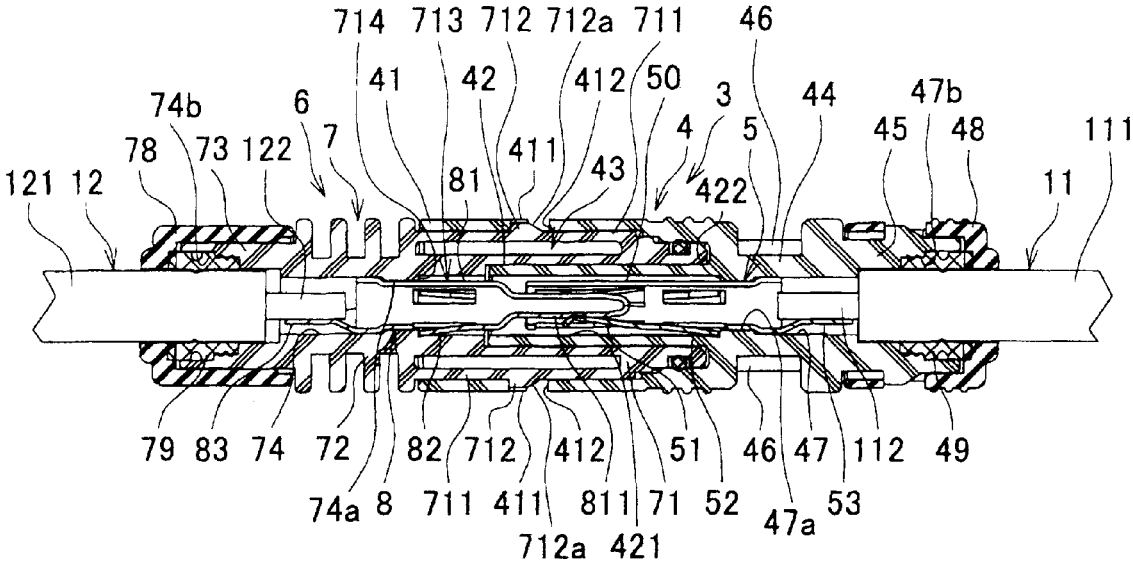
FIG. 6 is a cross-sectional view taken along VI-VI of FIG. 1.

As shown in FIG. 6, the socket contact 5 includes a contact main body 50, contact portions 51, lances 52, and a connection portion 53. The socket contact 5 is integrally formed of an elastic metal plate. The contact main body 50 has a substantially hollow cylindrical shape. The plurality of the contact portions 51 are arranged on the contact main body 50 along a circumferential direction of the contact main body 50 at predetermined intervals. The contact portions 51 are continuous with a front end of the contact main body 50. The plurality of the lances 52 are arranged on the contact main body 50 along the circumferential direction of the contact main body 50 at predetermined intervals. The connection portion 53 is continuous with a rear portion of the contact main body 50. The connection portion 53 is connected to a conductive wire 112 of the electric wire 11 by being swaged. The contact main body 50 of the socket contact 5 is inserted into the space 421 within the second cylinder portion 42 through the central hole 47. The lances 52 of the socket contact 5 inserted in the space 421 are engaged with the stepped surface 422, whereby the socket contact 5 is prevented from being removed from the second cylinder portion 42.

Figure 4:
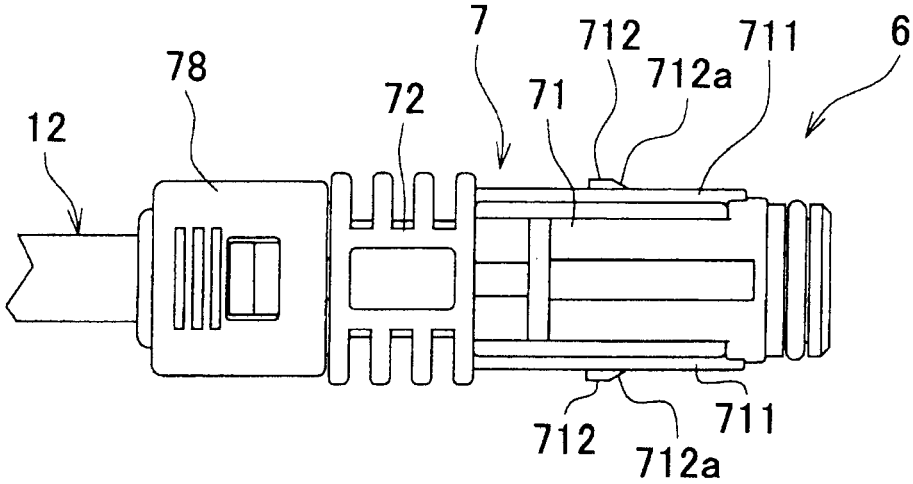
FIG. 4 is a side view of the plug connector of the connector device shown in FIG. 1.
Figure 5:
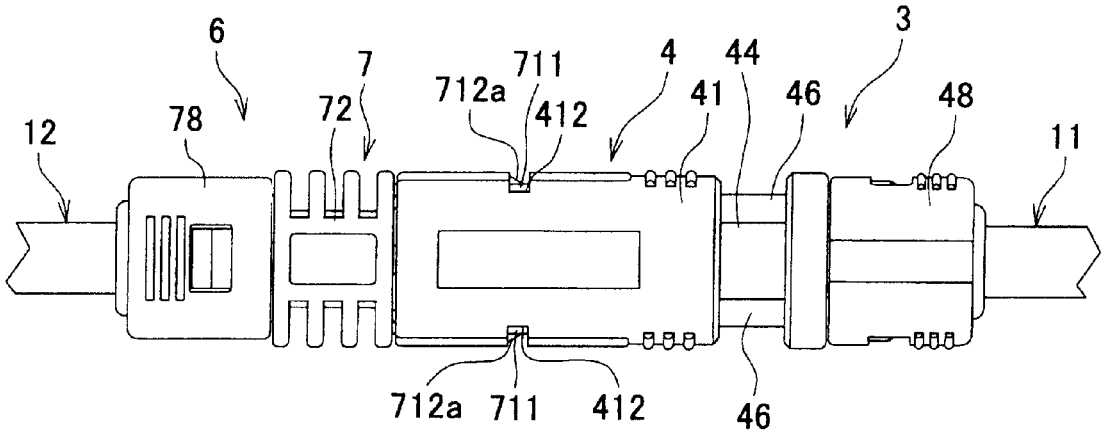
FIG. 5 is a side view of the receptacle connector and the plug connector of the connector device shown in FIG. 1 in the locked state.

As shown in FIGS. 4, 5, and 6, the plug connector 6 includes a plug housing 7 and a pin contact 8.

The plug housing 7 includes a housing main body (connector main body) 71, a linking portion 72, and a wire-holding portion 73. The plug housing 7 is integrally molded of e.g. a synthetic resin.

The housing main body 71 has a substantially hollow cylindrical shape. The housing main body 71 has an outer peripheral surface formed with two leaf springs (spring portion) 711. The two leaf springs 711 are at locations symmetric with respect to the central axis of the housing main body 71. Each leaf spring 711 is in the form of a both end-supported beam, and extends in the fitting and removing direction D1. Each leaf spring 711 has opposite ends supported by the housing main body 71, and an intermediate portion formed with a lug (protruding portion) 712. The lug 712 is formed with an inclined surface 712*a*. The lug 712 is accommodated in an associated one of the through holes 411 of the receptacle housing 4, but does not protrude outside the associated through hole 411. When the lug 712 is accommodated in the associated through hole 411, the inclined surface 712*a* is slid into an associated one of the guide grooves 412 of the first cylinder portion 41.

The wire-holding portion 73 is continuous with a rear end portion of the housing main body 71 (left portion of the housing main body 71 as viewed in FIG. 6) via the linking portion 72. The linking portion 72 has a substantially hollow cylindrical shape. The wire-holding portion 73 has a substantially hollow cylindrical shape, and holds a front end portion of a cover 121 of an electric wire 12. A central hole 74 extending through the wire-holding portion 73 and the linking portion 72 along the central axis communicates with a space 713 within the housing main body 71. A front end portion 74*a* of the central hole 74 has an inner diameter smaller than that of the space 713, and the housing main body 71 has an inner periphery surface formed with a stepped surface 714 (see FIG. 6). A rear end portion 74*b* of the central hole 74 has an inner diameter larger than that of the front end portion 74*a* of the central hole 74, and accommodates a bushing 79 mounted on an outer peripheral surface of the electric wire 12. A coupling nut 78 is removably mounted to the wire-holding portion 73. The coupling nut 78 mounted to the wire-holding portion 73 prevents the bushing 79 from falling off.

As shown in FIG. 6, the pin contact 8 includes a contact main body 81, lances 82, and a connection portion 83. The pin contact 8 is integrally formed of an elastic metal plate. A front portion of the contact main body 81 (right portion of the contact main body 81 as viewed in FIG. 6) is formed into a pin-like shape, and forms a contact portion 811. A rear portion of the contact main body 81 (left portion of the contact main body 81 as viewed in FIG. 6) has a substantially hollow cylindrical shape. The plurality of the lances 82 are arranged on the rear portion of the contact main body 81 along the circumferential direction of the contact main body 81 at equally-spaced intervals. The connection portion 83 is continuous with the rear portion of the contact main body 81. The connection portion 83 is connected to a conductive wire 122 of the electric wire 12 by being swaged. The contact main body 81 of the pin contact 8 is inserted into the space 713 within the housing main body 71 through the central hole 74. The lances 82 of the pin contact 8 inserted in the space 713 are engaged with the stepped surface 714, whereby the pin contact 8 is prevented from being removed from the housing main body 71.

Figure 9:
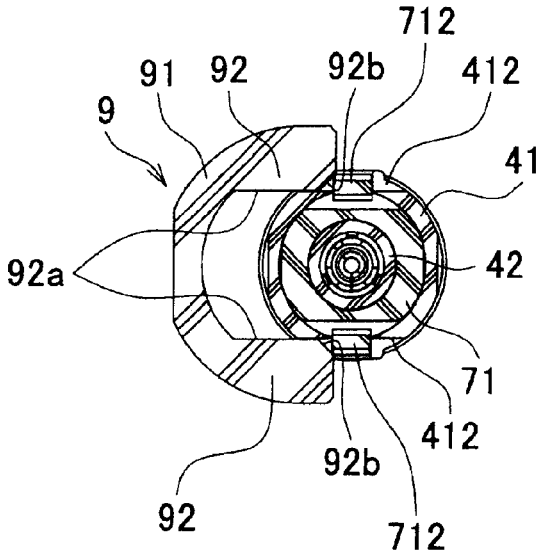
FIG. 9 is a cross-sectional view taken along of IX-IX FIG. 7.
Figure 10:
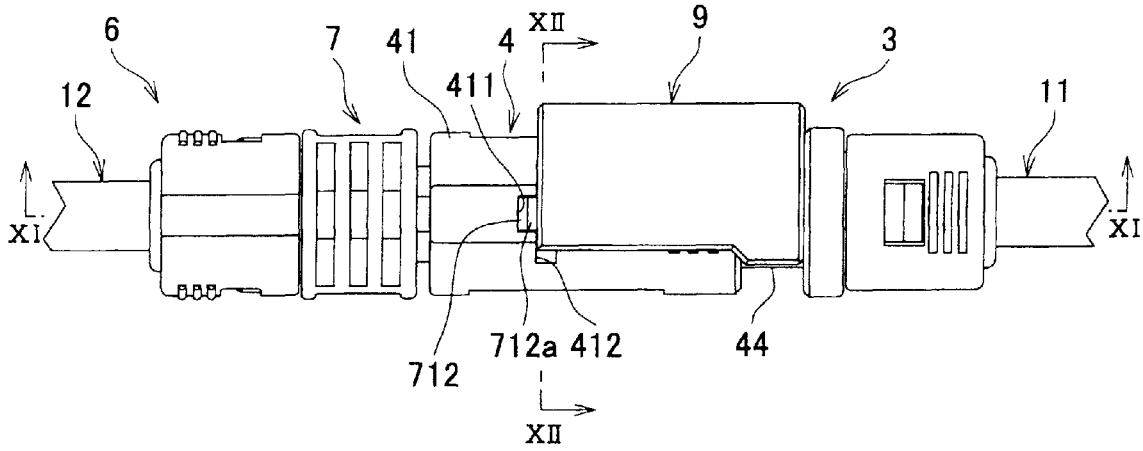
FIG. 10 is a plan view of the connector device shown in FIG. 1 in a state in which mounting of the unlocking jig to the receptacle connector has been completed, and the locked state has been released.
Figure 12:
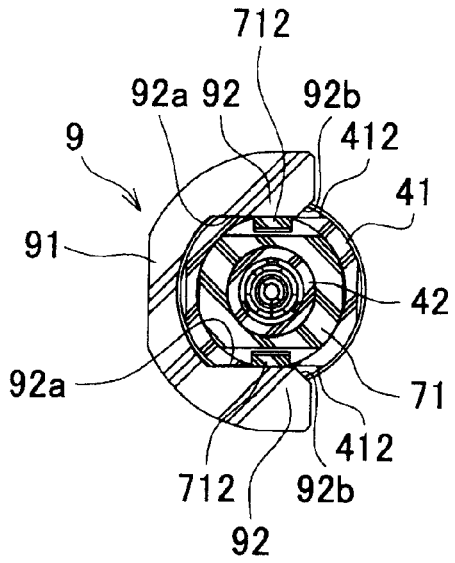
FIG. 12 is a cross-sectional view taken along XII-XII of FIG. 10.

As shown in FIGS. 1, 9, and 12, the unlocking jig 9 includes a jig main body 91, two protrusions (pressing portions) 92, and two attitude-stabilizing protrusions 93. The unlocking jig 9 is integrally molded of a material capable of being elastically deformed. The jig main body 91 has a hollow semi-cylindrical shape. The two protrusions 92 are arranged on an inner peripheral surface of one end (one end in a direction along the central axis of the jig main body 91) of the jig main body 91 in a manner opposed to each other in the radial direction. The protrusions 92 each have a pressing surface 92*a* and an inclined surface 92*b*. The pressing surface 92*a* is a substantially flat surface. The two pressing surfaces 92*a* are parallel to each other. The inclined surface 92*b* is continuous with one end of the pressing surface 92*a*. The two attitude-stabilizing protrusions 93 are arranged on an inner peripheral surface of the other end (the other end in the direction along the central axis of the jig main body 91) of the jig main body 91 in a manner opposed to each other in the radial direction. The attitude-stabilizing protrusions 93 each have three guided surfaces 93*a*, 93*b*, and 93*c*. Each guided surface 93*a* is a flat surface. The guided surfaces 93*a* of the two attitude-stabilizing protrusions 93 are parallel to each other. The guided surfaces 93*b* and 93*c* are surfaces perpendicular to the guided surface 93*a*.

As shown in FIGS. 5, and 6, when the plug connector 6 is inserted (fitted) into the receptacle connector 3, the housing main body 71 of the plug housing 7 is accommodated in the circular space 43 of the receptacle housing 4, and the lugs 712 of the plug housing 7 are engaged in the respective through holes 411 of the receptacle housing 4 by the spring forces of the leaf springs 711. As a result, the plug housing 7 is locked to the receptacle housing 4, whereby the receptacle connector 3 and the plug connector 6 are maintained in a fitted state. Since the lugs 712 fitted in the through holes 411 do not protrude from the respective through holes 411, the receptacle connector 3 and the plug connector 6 cannot be released from the state locked to each other by pressing the lugs 712 with fingers of an operator, not shown. Therefore, it is possible to prevent the receptacle connector 3 and the plug connector 6 from being released from the state locked to each other by erroneous handling by the operator.

Further, when the receptacle connector 3 and the plug connector 6 are fitted to each other, the contact portion 811 of the pin contact 8 of the plug connector 6 is inserted into the contact main body 50 of the socket contact 5 of the receptacle connector 3, and the contact portion 811 of the pin contact 8 is brought into contact with the contact portions 51 of the socket contact 5. As a result, the electric wire 11 and the electric wire 12 are electrically connected to each other.

Next, a description will be given of the unlocking operation. To release the receptacle connector 3 and the plug connector 6 from the state locked to each other, it is only necessary to mount the unlocking jig 9 appearing in FIG. 1 to the receptacle connector 3 along the direction D2 perpendicular to the fitting and removing direction D1.

Figure 7:
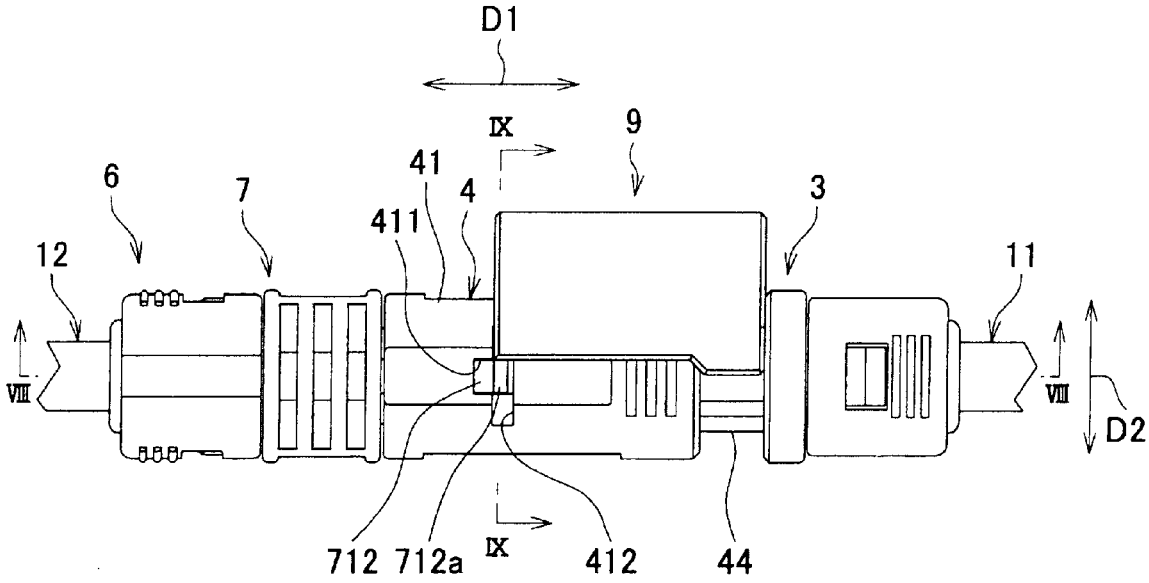
FIG. 7 is a plan view of the connector device shown in FIG. 1 in a state before mounting of the unlocking jig to the receptacle connector has been completed, and the locked state has not been released yet.
Figure 8:
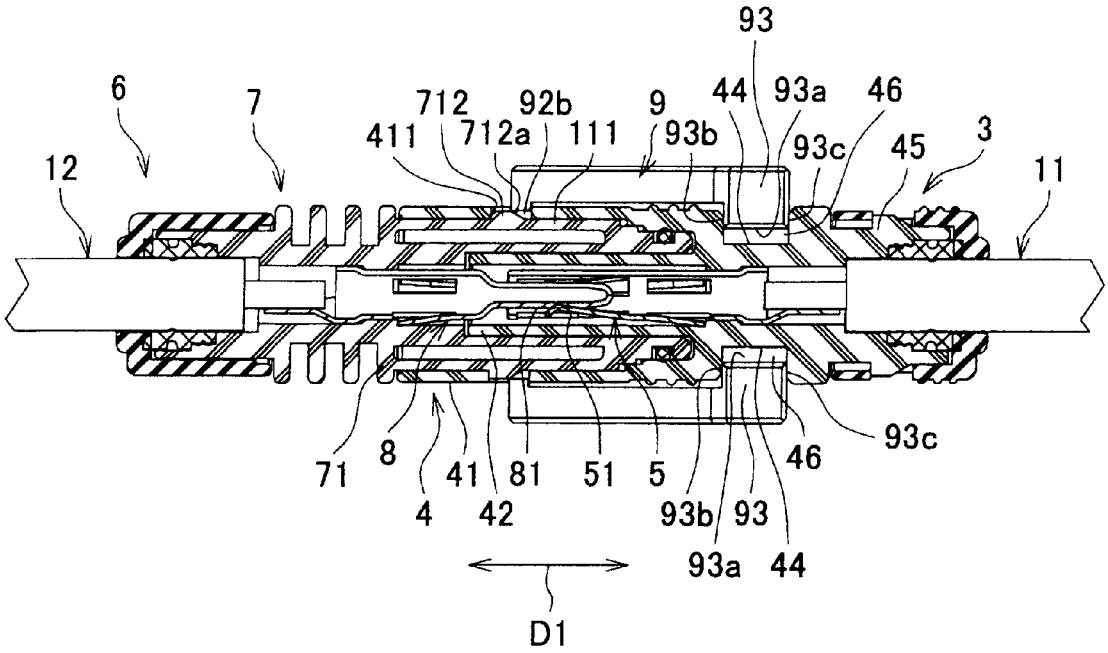
FIG. 8 is a cross-sectional view taken along VIII-VIII of FIG. 7.

While the unlocking jig 9 is moved from a position where the mounting of the unlocking jig 9 on the receptacle connector 3 is started (a state illustrated in FIGS. 7, 8, and 9) to a position where the mounting of the unlocking jig 9 is completed (a state illustrated in FIGS. 11, 12, and 13), the attitude-stabilizing protrusions 93 of the unlocking jig 9 are each slid on the associated one pair of the ribs 46. At this time, the guided surfaces 93*a* of the attitude-stabilizing protrusions 93 are moved while being brought into contact with the respective associated pairs of the ribs 46, and the guided surfaces 93*b* and 93*c* are moved while being brought into contact with inner surfaces of the constricted portion 44, the unlocking jig 9 is smoothly guided in the direction D2 perpendicular to the fitting and removing direction D1, and is prevented from pivoting about the central axis of the unlocking jig 9.

Further, while the unlocking jig 9 is moved from the position where the mounting of the unlocking jig 9 is started to the position where the mounting of the unlocking jig 9 is completed, the protrusions 92 of the unlocking jig 9 are slid within the respective guide grooves 412 of the receptacle housing 4, and the inclined surface 92*b* of each protrusion 92 climbs up the inclined surface 712*a* of an associated one of the lugs 712 of the plug housing 7, and presses down the associated lug 712 against the spring force of an associated one of the leaf springs 711. When the pressing surface 92*a* of each protrusion 92 presses the inclined surface 712*a* of the associated lug 712, each lug 712 is removed from the associated through hole 411, whereby the receptacle connector 3 and the plug connector 6 are released from the state locked to each other. Therefore, the plug connector 6 can be pulled out from the receptacle connector 3 by hand.

Figure 11:
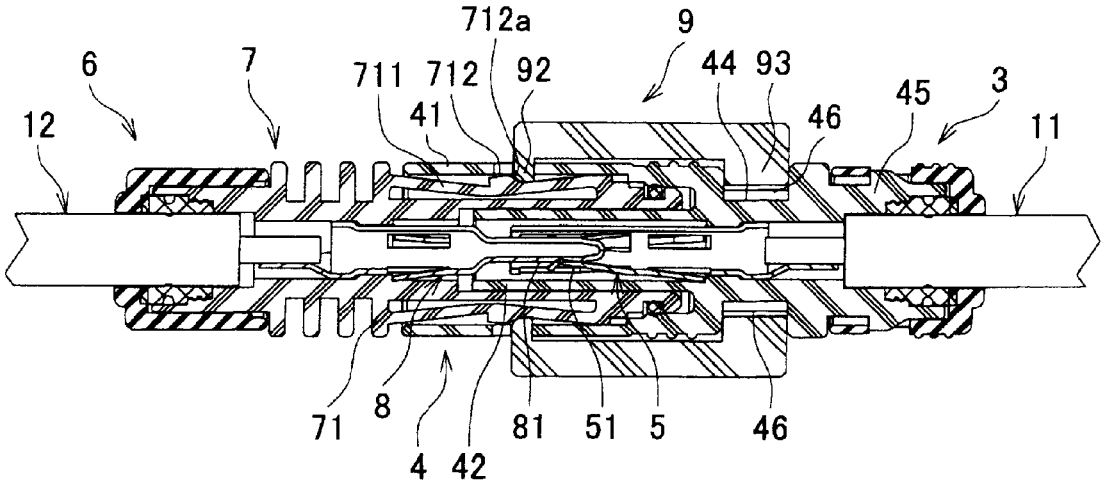
FIG. 11 is a cross-sectional view taken along XI-XI of FIG. 10.

Note that when the receptacle connector 3 and the plug connector 6 are released from the state locked to each other, since the inclined surfaces 712*a* are pressed by the respective pressing surfaces 92*a*, the plug connector 6 is slightly moved to the left as viewed in FIG. 11 (FIG. 11 shows a state in which the plug connector 6 is slightly moved to the left). As a result, even when the unlocking jig 9 is removed from the receptacle connector 3, the lugs 712 cannot return to the respective through holes 411, whereby the unlocked state is maintained.

According to the present embodiment, when the receptacle connector 3 and the plug connector 6 should not be released from the state locked to each other, since the lugs 712 of the plug connector 6 cannot be pressed out from the respective through holes 411 of the receptacle connector 3 by hand, it is possible to prevent the receptacle connector 3 and the plug connector 6 from being erroneously released from the state locked to each other by hand, whereas when the receptacle connector 3 and the plug connector 6 should be released from the state locked to each other, the plug connector 6 or the receptacle connector 3 is held with one hand of the operator, and the unlocking jig 9 is operated with the other hand, whereby the engagement between the lugs 712 and the through holes 411 can be easily released. As a result, it is possible to easily remove the plug connector 6 from the receptacle connector 3 by the operator alone.

On the other hand, in the above-described conventional connector device, when the plug connector is removed from the receptacle connector, it is necessary to simultaneously put the front ends of the two screwdrivers into the two rectangle holes of the receptacle connector to release the engagement between the locking lugs of the spring pieces and the rectangle holes, and then pull out the plug connector from the receptacle connector in this state, and hence it is impossible to remove the plug connector from the receptacle connector by the operator alone.

Next, a description will be given of a connector device according to another embodiment of the present invention with reference to FIG. 13.

Figure 13:
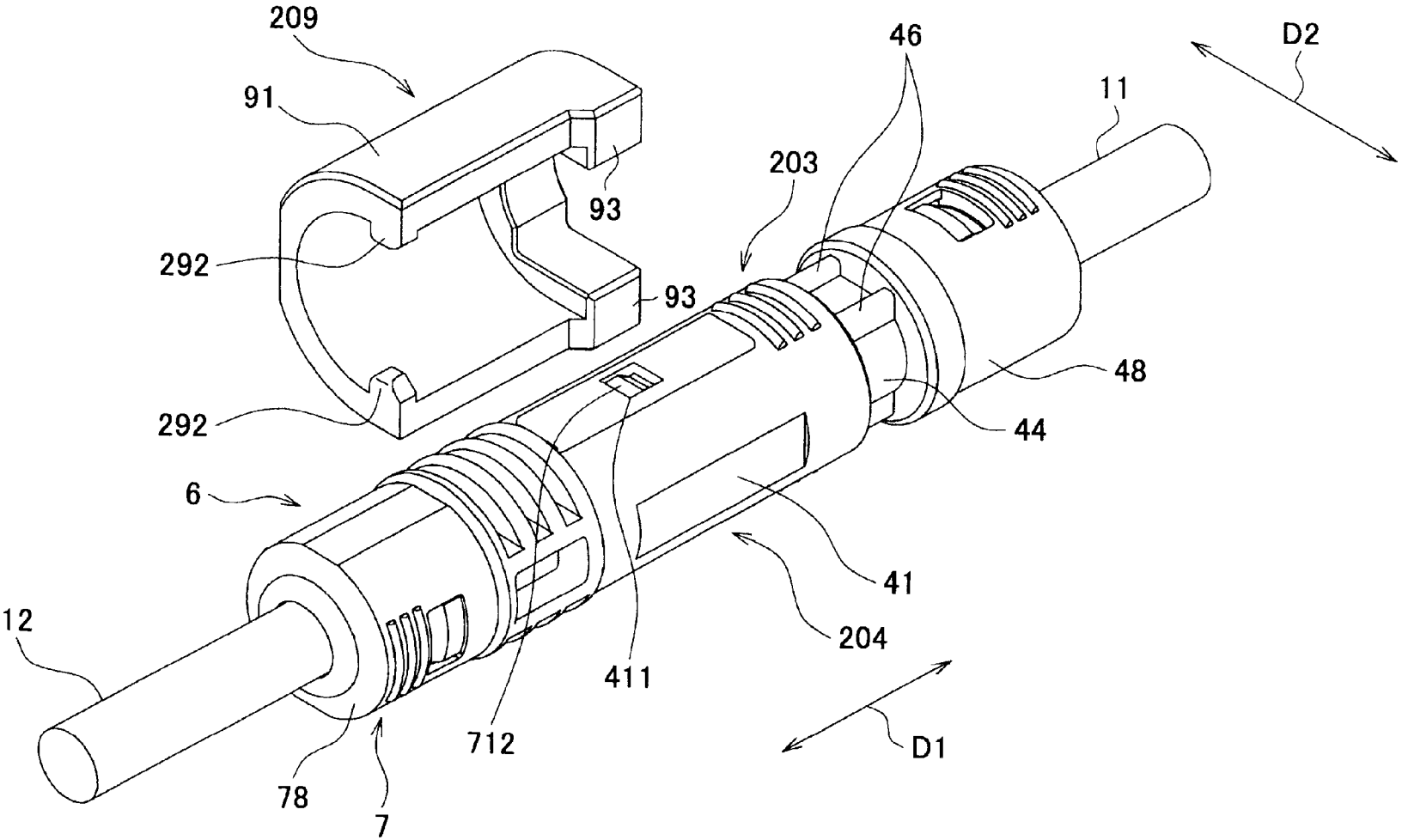
FIG. 13 is a perspective view of a connector device according to another embodiment of the present invention in a state before releasing a receptacle connector and a plug connector from a state locked to each other using an unlocking jig.

FIG. 13 is a perspective view showing a state before releasing a receptacle connector 203 and the plug connector 6 of a connector device 201 according to the present embodiment from the state locked to each other using an unlocking jig 209.

Component parts identical to those of the connector device according to the above-described embodiment (embodiment shown in FIGS. 1 to 12) are designated by identical reference numerals, and detailed description thereof is omitted. Hereafter, a description will be given of only main component parts different in construction from those of the above-described embodiment.

In the above-described embodiment, the receptacle housing 4 is formed with the guide grooves 412 to thereby enable the protrusions 92 as the pressing portions to move into the respective through holes 411 via the guide grooves 412. On the other hand, in the present embodiment, a receptacle housing 204 is not formed with a guide groove, so that protrusions 292 as the pressing portions move into the respective through holes 411 in a manner sliding along an outer peripheral surface of the receptacle housing 204.

The protrusions 292 are each formed into a shape which can be accommodated in the through hole 411. The protrusions 292 which have moved into the respective through holes 411 press out the lugs 712 from the through holes 411 against the urging force of the leaf springs 711 applied to the lugs 712 to thereby release the receptacle connector 203 and the plug connector 6 from the state locked to each other.

According to the present embodiment, it is possible to obtain the same advantageous effect as provided by the first embodiment, and since the guide grooves 412 are not necessary, it is possible to more easily produce the receptacle connector 203.

Note that although in the above-described two embodiments, the rectangle through holes 411 are provided in the receptacle housings 4 and 204 as the through holes, the shape of each through hole is not limited to a rectangle.

Further, although the constricted portion 44 is employed as the guide portion, the guide portion is not limited to the constricted portion 44, but two linear grooves parallel to each other may be employed insofar as they can guide the attitude-stabilizing protrusions 93 in the direction D2 perpendicular to the fitting and removing direction D1.

Although the unlocking jigs 9 and 209 each have a hollow semi-cylindrical shape, the shape of the unlocking jigs 9 and 209 is not limited to a hollow semi-cylindrical shape, but may be substantially U-shaped in close-section, or the like.

Further, although the leaf springs 711 are used for the spring portions, the spring portions are not limited to the leaf springs 711.

Although the protrusions are employed as the pressing portions each having such a shape as that of the lug 712 including the inclined surface 712*a*, the shape of the protrusion may be a hemispherical shape or a shape formed by cutting a hemisphere into half.

Further, although the pressing portions are protrusions, each pressing portion may be constituted, as one other than a protrusion, by a movable member, such as a ball or a pin, and a spring which presses the movable member against the receptacle connector.

Further, as for another pressing portion, there is an unlocking jig of a clip type, formed by halving the jig main body, linking a pair of halved members with a hinge, and mounting a spring between the pair of the halved members. Front ends of the unlocking jig can be opened and closed, and protrusions formed on the respective front ends may press out the lugs from the through hole 411.

Note that although the receptacle housing 4 of the receptacle connectors 3 and 203 of the connector devices 1 and 201 according to the above-described two embodiments has a hollow cylindrical shape, the receptacle housing may have a tube-like shape (e.g. hollow prism shape) other than the hollow cylindrical shape.

Further, when the unlocking jig 9 is mounted to the receptacle connector 3 in the state fitted to the plug connector 6, the attitude-stabilizing protrusions 93 are moved into the constricted portion 44, the protrusions 92 are moved into the guide grooves 412, respectively. However, the jig main body 91 having a hollow semi-cylindrical shape has one end provided with the protrusions 92 as the pressing portions and the other end provided with the attitude-stabilizing protrusions 93, and the arc of the one end of the jig main body 91 is longer than that of the other end of the jig main body 91 (see FIGS. 1, 7, and 10), so that the timing in which the attitude-stabilizing protrusions 93 are moved into the constricted portion 44 is slightly earlier than that in which the protrusions 92 are moved into the respective guide grooves 412. Therefore, the jig main body 91 is guided to the receptacle connector 3 in the direction D2 perpendicular to the fitting and removing direction D1, and the protrusions 92 are smoothly moved into the respective guide grooves 412.

It is further understood by those skilled in the art that the foregoing are the preferred embodiments of the present invention, and that various changes and modification may be made thereto without departing from the spirit and scope thereof.

REFERENCE SIGNS LIST

1 connector device
3, 203 receptacle connector
4, 204 receptacle housing
411 through hole
412 guide groove
44 constricted portion (guide portion)
6 plug connector
7 plug housing
711 leaf spring (spring portion)
712 lug (protruding portion)
9, 209 unlocking jig
91 jig main body
92, 292 protrusion (pressing portion)
93 attitude-stabilizing protrusion
D1 fitting and removing direction
D2 direction perpendicular to the fitting and removing direction

The invention claimed is:

1. An unlocking jig for releasing engagement between through holes of a receptacle connector and protruding portions of a plug connector to thereby release the receptacle connector and the plug connector inserted in the receptacle connector from a state locked to each other, the unlocking jig comprising:

a jig main body that is mountable to and removable from the receptacle connector in a direction perpendicular to a direction of fitting and removing the plug connector and the receptacle connector to and from each other; and pressing portions that are provided on said jig main body, for pressing, when said jig main body is mounted to the receptacle connector, the protruding portions against urging forces of spring portions of the plug connector, which urge the protruding portions toward the through holes, to thereby release engagement between the protruding portions and the through holes, wherein said jig main body has a hollow semi-cylindrical shape, and wherein said pressing portions are a pair of protrusions which are arranged on an inner peripheral surface of a first end of said jig main body in a manner opposed to each other in a radial direction of said jig main body, and are guided by respective guide grooves formed in an outer peripheral surface of the receptacle connector such that the guide grooves extend across the respective through holes in the direction perpendicular to the fitting and removing direction.

2. The unlocking jig as claimed in claim 1, wherein said jig main body is guided by a guide portion formed on the outer peripheral surface of the receptacle connector when being mounted to the receptacle connector, and wherein the unlocking jig further comprises a pair of attitude-stabilizing protrusions for stabilizing an attitude of said jig main body with respect to the receptacle connector, the attitude-stabilizing protrusions being formed on an inner peripheral surface of a second end of said jig main body in a manner opposed to each other in the radial direction.

3. A connector device comprising:

a receptacle connector;

a plug connector that is insertable into said receptacle connector; and an unlocking jig for releasing said receptacle connector and said plug connector from a state locked to each other, wherein said receptacle connector has through holes, wherein said plug connector has protruding portions which are engageable in the through holes, spring portions which urge said protruding portions toward the through holes such that the through holes and said protruding portions are engaged when said plug connector is inserted in said receptacle connector, and a connector main body which supports said spring portions, and wherein said unlocking jig includes a jig main body that is mountable to and removable from said receptacle connector in a direction perpendicular to a direction of fitting and removing said plug connector and said receptacle connector to and from each other, and pressing portions that are provided on said jig main body, for pressing, when said jig main body is mounted to said receptacle connector, said protruding portions against urging forces of said spring portions, to thereby release engagement between said protruding portions and the through holes.

4. The connector device as claimed in claim 3, wherein said receptacle connector has guide grooves for guiding said pressing portions in the direction perpendicular to the fitting and removing direction when said jig main body is mounted to said receptacle connector, the guide grooves being formed in an outer peripheral surface of said receptacle connector such that the guide grooves extend across the respective through holes.

5. The connector device as claimed in claim 3, wherein said jig main body has a hollow semi-cylindrical shape, and said pressing portions are a pair of protrusions arranged on an inner peripheral surface of a first end of said jig main body in a manner opposed to each other in a radial direction of said jig main body.

6. The connector device as claimed in claim 5, wherein said jig main body has a pair of attitude-stabilizing protrusions formed on an inner peripheral surface of a second end thereof in a manner opposed to each other in the radial direction, and wherein said receptacle connector has a guide portion formed on an outer peripheral surface thereof, which guides the pair of said attitude-stabilizing protrusions when said jig main body is mounted to said receptacle connector to thereby stabilize an attitude of said jig main body with respect to said receptacle connector.

7. The connector device as claimed in claim 5, wherein said protruding portions each have a shape which causes said connector main body to move in a direction away from said receptacle connector when said protruding portions are pressed by the respective protrusions.

8. The connector device as claimed in claim 4, wherein said jig main body has a hollow semi-cylindrical shape, and said pressing portions are a pair of protrusions arranged on an inner peripheral surface of a first end of said jig main body in a manner opposed to each other in a radial direction of said jig main body.

9. The connector device as claimed in claim 8, wherein said jig main body has a pair of attitude-stabilizing protrusions formed on an inner peripheral surface of a second end thereof in a manner opposed to each other in the radial direction, and wherein said receptacle connector has a guide portion formed on an outer peripheral surface thereof, which guides the pair of said attitude-stabilizing protrusions when said jig main body is mounted to said receptacle connector to thereby stabilize an attitude of said jig main body with respect to said receptacle connector.

10. The connector device as claimed in claim 8, wherein said protruding portions each have a shape which causes said connector main body to move in a direction away from said receptacle connector when said protruding portions are pressed by the respective protrusions.

11. The connector device as claimed in claim 9, wherein said protruding portions each have a shape which causes said connector main body to move in a direction away from said receptacle connector when said protruding portions are pressed by the respective protrusions.

12. The connector device as claimed in claim 6, wherein said protruding portions each have a shape which causes said connector main body to move in a direction away from said receptacle connector when said protruding portions are pressed by the respective protrusions.

13. A connector comprising:

a receptacle connector; and a plug connector that is insertable into said receptacle connector, wherein said receptacle connector has through holes, and wherein said plug connector has protruding portions which are engageable in the through holes, spring portions which urge said protruding portions toward the through holes such that the through holes and said protruding portions are engaged with each other when said plug connector is inserted in said receptacle connector, and a connector main body which supports said spring portions, and wherein said receptacle connector has an outer peripheral surface formed with guide grooves each of which extends across an associated one of the through holes in a direction perpendicular to a direction of fitting and removing said receptacle connector and said plug connector to and from each other, and receives at least part of an associated one of said protruding portions when said protruding portions are engaged in the respective through holes.

14. The connector as claimed in claim 13, wherein when releasing fitting between said receptacle connector and said plug connector, the guide grooves guide respective pressing portions of an unlocking jig for pressing said protruding portions to thereby release engagement between said protruding portions and the respective through holes, in the direction perpendicular to the fitting and removing direction.

* * * * *